US005637959A

United States Patent [19]

Kyushima et al.

[11] Patent Number: 5,637,959

[45] Date of Patent: Jun. 10, 1997

[54] POSITION SENSITIVE PHOTOMULTIPLIER

[75] Inventors: Hiroyuki Kyushima; Eiichiro Kawano; Masuya Mizuide; Hiroto Yokota, all of Hamamatsu, Japan

[73] Assignee: Hamamatsu Photonics K.K., Hamamatsu, Japan

[21] Appl. No.: 518,843

[22] Filed: Aug. 24, 1995

[30] Foreign Application Priority Data

Aug. 24, 1994 [JP] Japan ..... 6-199893

[51] Int. Cl.[6] ..... H01J 43/12; H01J 43/04

[52] U.S. Cl. ..... 313/533; 313/532; 313/540

[58] Field of Search ..... 313/531, 532, 313/533, 534, 535, 536, 540

[56] References Cited

U.S. PATENT DOCUMENTS

| | | | |
|---|---|---|---|
| 4,070,578 | 1/1978 | Timothy et al. | 250/336 |
| 4,117,366 | 9/1978 | Davis | 313/95 |
| 4,649,314 | 3/1987 | Eschard | 313/103 |
| 4,937,506 | 6/1990 | Kimura et al. | 313/533 |
| 5,077,504 | 12/1991 | Helvy | 313/533 |

FOREIGN PATENT DOCUMENTS

| | | |
|---|---|---|
| 0 622 824 | 11/1994 | European Pat. Off. . |
| 2 481 004 | 10/1981 | France . |
| 39 03 750 | 8/1990 | Germany . |
| 3-102226 | 4/1991 | Japan . |
| 3-155036 | 7/1991 | Japan . |
| 5-182631 | 7/1993 | Japan . |

*Primary Examiner*—Nimeshkumar Patel

*Attorney, Agent, or Firm*—Cushman Darby & Cushman, IP Group of Pillsbury Madison & Sutro, LLP

[57] ABSTRACT

This invention relates to a photomultiplier for detecting the incident position of a plane of incidence, where a weak light beam is reached and to a photomultiplier having a structure for minimizing crosstalk near the incident position of the weak light beam to improve the precision of the position resolving power. Particularly, the anode of this photomultiplier, which extracts the incident position of the incident weak light as an electrical signal, is constituted by a first anode component for detecting the incident position of the incident plane in the X direction and a second anode component for detecting the incident position of the incident plane in the Y direction. The first and second anode components have flat surfaces. These flat surfaces cause the first and second anode components to capture secondary electrons emitted from a dynode in correspondence with the incident position of the weak light beam, at a position closer to the emission position. The photomultiplier detects the incident position of the weak light beam at a higher resolving power while minimizing the crosstalk.

23 Claims, 15 Drawing Sheets

POSITION SENSITIVE PHOTOMULTIPLIER

BACKGROUND OF THE INVENTION

1. Field of the Invention

The present invention relates to a position sensitive photomultiplier, applicable to scintillation imaging technologies in the field of high energy physics and medical applications.

2. Related Background Art

A conventional technique in this technological field, is set forth in "POSITION SENSITIVE PHOTOMULTIPLIER TUBES FOR SCINTILLATION IMAGING" (NSS, 1986). The photomultiplier described has a cross wire anode between a dynode unit constituted by mesh dynodes and a last-stage dynode. Photoelectrons emitted from a photoelectric surface are sequentially cascade-multiplied by the mesh dynode at each stage, thereby emitting secondary electrons. The secondary electrons pass through the cross wire anode and are further multiplied by the last-stage dynode.

The secondary electrons multiplied by the last-stage dynode and orbit-inverted are captured by the cross wire anode and extracted from the photomultiplier.

The cross wire anode consists of two layers of anode groups in the X and Y directions perpendicular to each other. Each anode group is constituted by a plurality of wires arranged at a pitch of 3.0 to 7.0 mm and having a diameter of 0.5 to 1.0 mm. These wires are connected by resistor chains constituted by resistors connected in series. Secondary electrons extracted from wires of the upper and lower wire anode are shunted through the resistor chains and extracted from terminals $X_1$ and $X_2$ of one of the resistor chains and terminals $Y_1$ and $Y_2$ of another of the resistor chains. The terminals $X_1$ and $X_2$ are terminals of an X-component shunt circuit (resistor chain) constituted by resistors for electrically connecting between the wires of the upper wire anode. The terminals $Y_1$ and $Y_2$ are terminals of a Y-component shunt circuit (resistor chain) constituted by resistors for electrically connecting between the wires of the lower wire anode. By connecting an adder and a divider to each terminal, the position of the center of gravity in the X and Y directions can be obtained on the basis of the following equations:

$$X=X_2/(X_1+X_2)$$

$$Y=Y_2/(Y_1+Y_2)$$

The position (X, Y) means an incident position of a plane of incidence, where an incident weak light beam is reached.

SUMMARY OF THE INVENTION

The present invention relates to a photomultiplier for detecting an incident position of an incident plane in a X direction and Y direction, where a weak light beam is reached, and particularly has as its object to provide a photomultiplier having a structure for minimizing crosstalk near the incident position of the weak light beam to improve the precision of position resolving power.

In order to achieve the above object, according to the present invention, there is provided a photomultiplier as shown in FIG. 1, which comprises, in a vessel 10, a photocathode for emitting photoelectrons corresponding to an incident weak light beam, a dynode unit 20, arranged between the photocathode and a bottom portion 10*a* of the photomultiplier, for multiplying the photoelectrons emitted from the photocathode, the dynode unit 20 being constituted by stacking a plurality of dynode plates 23, each of which supports at least one dynode, along an incident direction 30 of the weak light beam, an anode 250 arranged between the dynode unit 20 and the bottom portion 10*a* of the photomultiplier and set at a potential higher than that of any one of the dynode plates 23, and an inverting dynode 26, arranged between the anode 250 and the bottom portion 10*a* of the photomultiplier and set at a potential lower than that of the anode 250, for receiving the secondary electrons passing through the anode 250 and emitting the secondary electrons toward the anode 250. The incident direction 30 of the weak light beam matches the stacking direction of the dynode plates 23. In FIG. 1, reference numerical 30*a* denotes a plane of incident, where the incident weak light beam is reached.

Particularly, the anode 250 has a first anode component 24 for detecting the incident position of the incident plane in a first direction (X direction) and a second anode component 25 for detecting the incident position of the incident plane in a second direction (Y direction) perpendicular to the first direction, as shown in FIG. 4. The first anode component 24 has through holes 24*b* for passing the secondary electrons multiplied by the dynode unit 20, a first surface 24*c* opposing the dynode unit 20, and a second flat surface 24*d* on an opposite side of the first surface 24*c*. The second anode component 25 is arranged between the first anode component 24 and the bottom portion 10*a* of the photomultiplier at a position separated from the first anode component 24 by a predetermined interval, has through holes 25*b* for passing the secondary electrons passing through the through holes 24*b* of the first anode component 24, a first surface 25*c* opposing the second surface 24*d* of the first anode component 24, and a second flat surface 25*d* on an opposite side of the first surface 25*c*.

The second flat surface 24*d* of the first anode component 24 is arranged parallel to the inverting dynode 26, and the second flat surface 25*d* of the second anode component 25 is arranged parallel to the inverting dynode 26 and the second flat surface 24*d* of the first anode component 24. The first anode component 24 and the second anode component 25 are set at an equal potential and separated from each other by a predetermined distance through an insulating member.

Voltage-dividing means 270 for supplying predetermined voltages to the dynodes 23 and 26 and the anode 250 through lead pins 15 externally introduced in the photomultiplier is provided outside the photomultiplier.

As shown in FIG. 4, the first anode component 24 is constituted by a plurality of metal plates 24*a* aligned in the first direction (X direction) perpendicular to the incident direction 30 of the weak light beam at a predetermined interval and extending in the second direction (Y direction) perpendicular to the first direction, each of which has the plurality of through holes 24*b* arranged in a line in the second direction. The second anode component 25 is also constituted by a plurality of metal plates 25*a* aligned in the second direction (Y direction) at a predetermined interval and extending in the first direction (X direction), each of which has the plurality of through holes 25*b* arranged in a line in the first direction.

As for a structure for fixing the first and second anode components 24 and 25 in a predetermined positional relationship, the end portions of the metal plates 24*a* and 25*a* are fixed to the sides of an insulating frame 32, as shown in FIG. 9.

The insulating frame comprises, at least, a first side 32*a* to which a first end portion of each of the metal plates 24*a* of the first anode component 24 is fixed, a second side 32*b* opposing the first side 32*a*, to which a second end portion of each of the metal plates 24*a* of the first anode component 24 is fixed, a third side 32*c* connecting the first side 32*a* and the second side 32*b*, to which a first end portion of each of the metal plates 25*a* of the second anode component 25 is fixed, and a fourth side 32*d* connecting the first side 32*a* and the second side 32*b*, to which a second end portion of each of the metal plates 25*a* of the second anode component 25 is fixed. With this structure, an air gap 320 between the first anode component 24 and the second anode component 25 is defined as a space surrounded by the sides.

The structure for fixing the first and second anode components 24 and 25 in a predetermined positional relationship may be constituted by a plurality of independent insulating bars 240*a*, 240*b*, 250*a*, and 250*b*, as shown in FIG. 12. More specifically, the first end portion of each of the metal plates 24*a* of the first anode component 24, which are aligned in the first direction at the predetermined interval, is fixed to the first insulating bar 240*a*. The second end portion of each of the metal plates 24*a* aligned in the first direction at the predetermined interval is fixed to the second insulating bar 240*b*. The first end portion of each of the metal plates 25*a* of the second anode component 25, which are aligned in the second direction at the predetermined interval, is fixed to the third insulating bar 250*a*. The second end portion of each of the metal plates 25*a* aligned in the first direction at the predetermined interval is fixed to the fourth insulating bar 250*b*. The end portions of these insulating bars 240*a*, 240*b*, 250*a*, and 250*b* are connected to each other and fixed, thereby constituting the insulating frame.

As shown in FIG. 13, the first anode component 24 and the second anode component 25 may be respectively constituted by insulating plates 33 and 34 having a plurality of through holes 33*b* and 34*b* and conductive thin films 33*a* and 34*a* (e.g., thin aluminum films) formed thereon. In this case, the first thin Al films 33*a* disposed on the surface of the first insulating plate 33 extend in the second direction (Y direction) and are aligned in the first direction (X direction) at a predetermined interval. The second thin Al films 34*a* disposed on the surface of the second insulating plate 34 extend in the first direction (X direction) and are aligned in the second direction (Y direction) at a predetermined interval.

A structure for fixing the first and second insulating plates 33 and 34 in a predetermined positional relationship can be obtained by fixing the first and second insulating plates 33 and 34 to the insulating frame 32, as shown in FIG. 13. The insulating frame 32 has the same structure as that of the frame shown in FIG. 9.

As shown in FIG. 14, each of the first thin Al films 33*a* covers the entire inner walls of the through holes 33*b* of the first insulating plate 33, the through holes 33*b* being located in a region on where the first thin film 33*a* is disposed. Each of the second thin Al films 34*a* covers the entire inner walls of the through holes 34*b* of the second insulating plate 34, the through holes 34*b* being located in a region on where the second thin films 34*a* is disposed.

In the photomultiplier according to the present invention, the secondary electrons multiplied by the dynode unit pass through the electron transmission holes of the first and second anode components. Thereafter, the orbit of the secondary electrons is inverted by the inverting dynode to the side of the first and second anode components. During inversion, the electrons are further multiplied by the inverting dynode, so that a plurality of electrons are emitted toward the first and second anode components. At this time, the plurality of electrons move at a predetermined spread angle. However, the anode components have a plate-like shape and a large surface area for capturing the electrons. For this reason, a lot of electrons are captured by the anode at a portion closer to the emission position before the secondary electrons from the inverting dynode reach a portion far from the emission position (corresponding to the incident position of the weak light beam in the incident plane 30*a*). Therefore, the incident position of the electrons can be detected at a high position resolving power while minimizing the crosstalk.

In the anode constituted by the two insulating plates having the thin metal films, the manufacture is facilitated as compared to the above anode having the plurality of metal plates aligned.

The present invention will be more fully understood from the detailed description given hereinbelow and the accompanying drawings, which are given by way of illustration only and are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will be apparent to those skilled in the art from this detailed description.

DETAILED DESCRIPTION OF THE PREFERRED EMBODIMENTS

Figure 3:
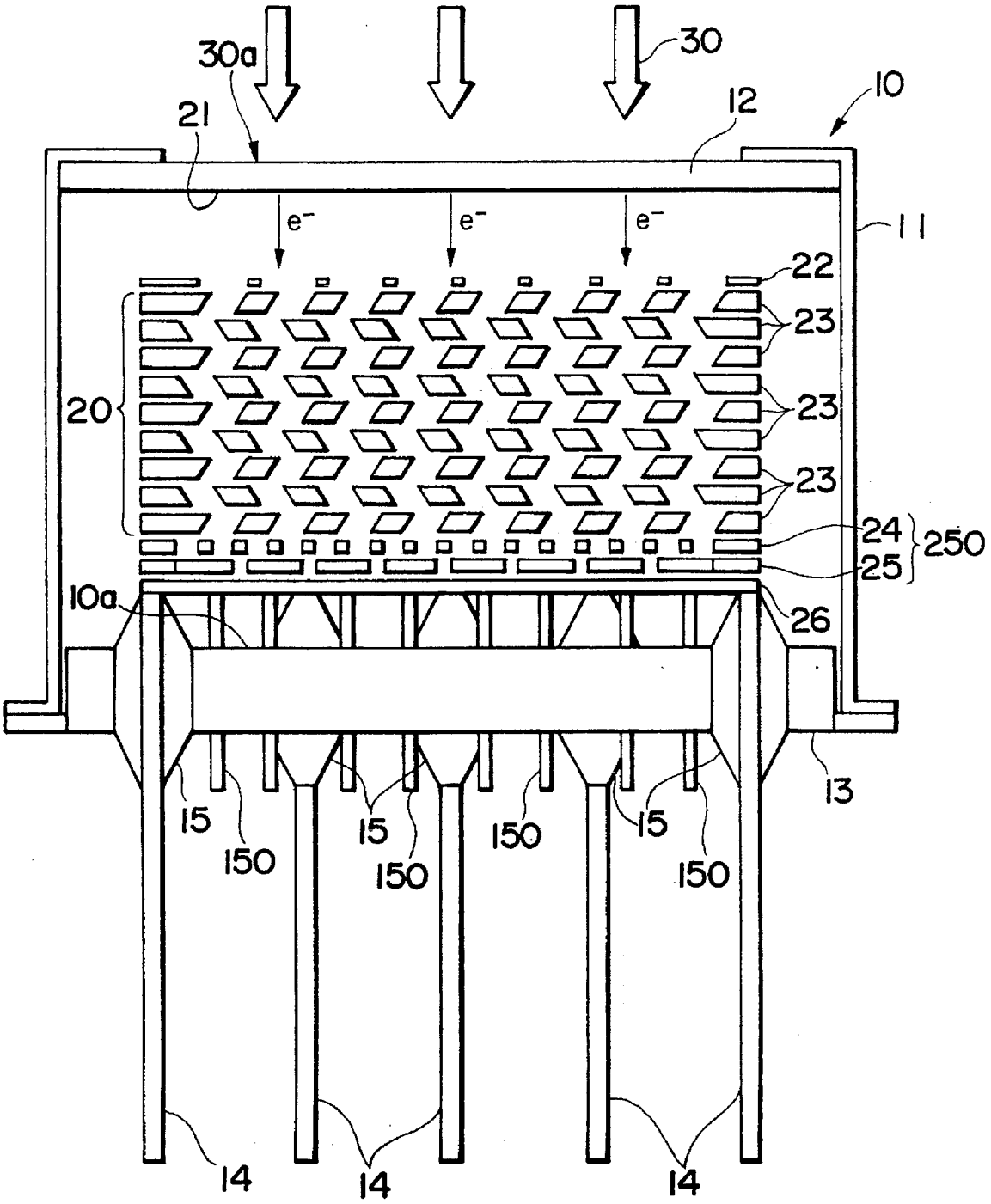
FIG. 3 is a sectional view showing the structure of a photomultiplier according to the present invention.

An embodiment of the present invention will be described below with reference to the accompanying drawings. FIG. 3 is a sectional view showing the structure of a photomultiplier according to this embodiment. Referring to FIG. 3, the photomultiplier of this embodiment has a structure wherein a dynode unit 20 for multiplying an incident electron flow is disposed in a columnar vacuum vessel 10. The vacuum vessel 10 is constituted by a cylindrical metal side tube 11, a circular light-receiving plate 12 arranged at one end of the metal side tube 11, and a circular stem 13 forming a base portion arranged at the other end of the metal side tube 11. A photocathode 21 is provided on the inner surface of the light-receiving plate 12. An incident plane 30*a* where a light beam is reached is on an opposite side of the inner surface of the light-receiving plate 12. A focusing electrode 22 is disposed between the photocathode 21 and the dynode unit 20.

The dynode unit 20 is constituted by stacking dynode plates 23 each having a lot of electron multiplication holes. A first anode component 24 (for detecting the incident position of an incident plane 30*a* in the X direction, where the light beam is reached), a second anode component 25 (for detecting the incident position of the incident plane 30*a* in the Y direction, where the light beam is reached), and an inverting dynode 26 at the last stage are sequentially disposed under the dynode plates 23.

These elements are arranged parallel to a bottom portion 10*a* of the vessel 10.

The stem 13 serving as a base portion is connected to an external voltage terminal, through which a total of 12 stem pins 14 for applying a predetermined voltage to the dynode plates 23 and 26 extend. The stem pins 14 are fixed to the stem 13 through tapered hermetic glass 15. Each stem pin 14 has a length reaching a corresponding connected dynode. The distal end of each stem pin 14 is resistance-welded to the connecting terminal of the corresponding one of the dynode plates 23 and 26. This structure is disclosed in detail in U.S. patent application Ser. No. 08/234,142.

A light beam (reference numeral 30 denotes an incident direction of the light beam which reaches the incident plane 30*a* of the light-receiving plate 12) incident on the light-receiving plate 12 excites electrons in the photocathode 21 on the lower surface (inner surface of the vessel 10) and emits photoelectrons into the vacuum in the vessel 10. The photoelectrons emitted from the photocathode 21 are focused onto the uppermost dynode plate 23 through the matrix-like focusing electrode 22 to be subjected to secondary multiplication. The secondary electrons emitted from the uppermost dynode plate 23 are applied to the lower dynode plates 23, and secondary electron emission is repeated. The emitted secondary electrons pass through through holes 24*b* and 25*b* of the first and second anode components 24 and 25 constituting an anode 250, and then reach the inverting dynode 26 at the last stage. The secondary electron group emitted from the inverting dynode 26 is captured by the first and second anode components 24 and 25.

The captured secondary electron group is extracted from the photomultiplier through lead pins 150 individually connected to the first anode component 24 and the second anode component 25.

Except for the anode 250, the structure of this photomultiplier is disclosed in, e.g., U.S. Pat. Nos. 4,649,314 and 4,937,506 and Japanese Patent Laid-Open Nos. 3-155036 and 5-182631. The anode 250 of the present invention can be applied to the photomultipliers disclosed in these prior arts.

Figure 4:
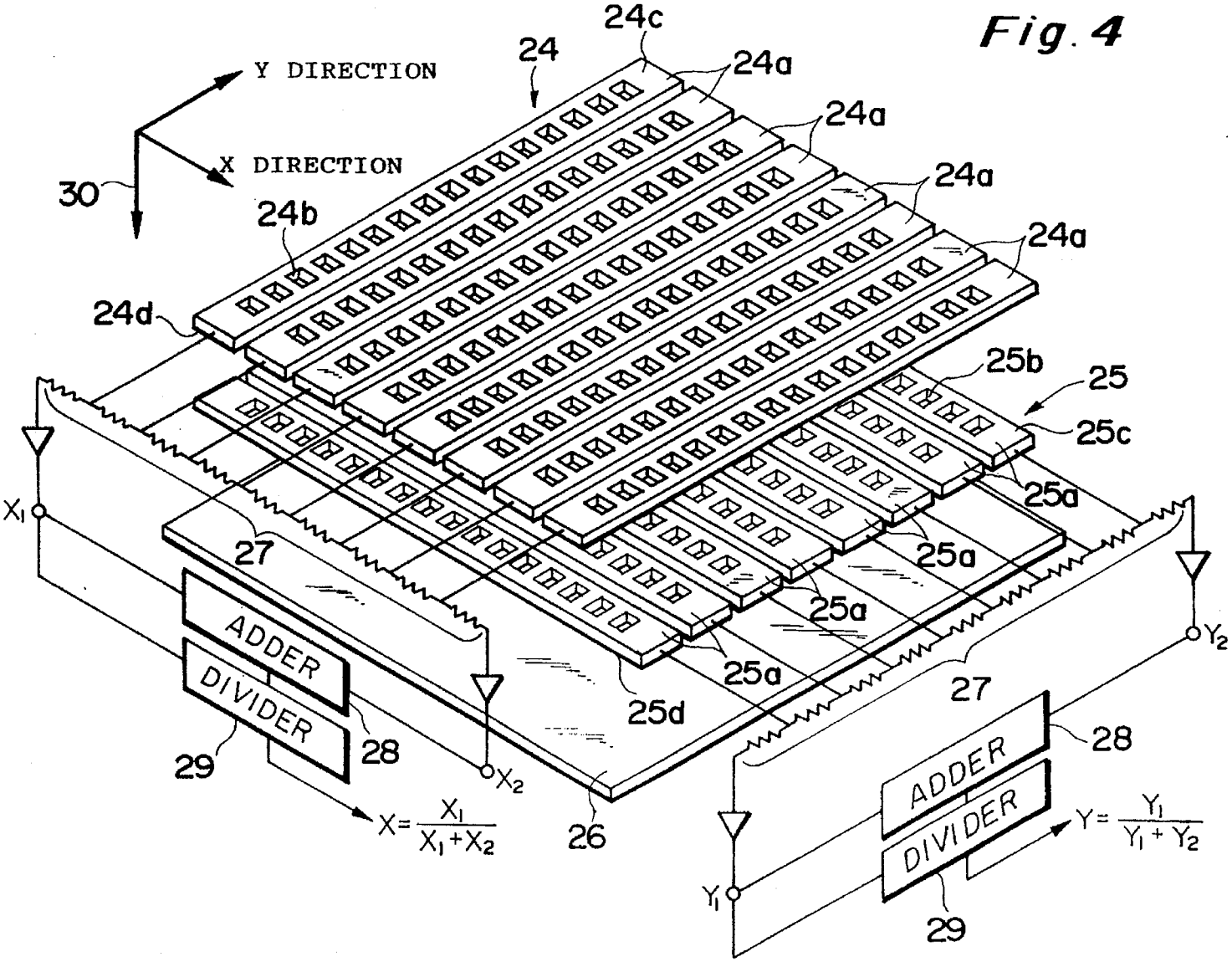
FIG. 4 is a perspective view showing the typical structure of the anode of the photomultiplier shown in FIGS. 1 and 3, and a signal processing means for detecting the capture position of the secondary electrons (corresponding to the incident position of a weak light beam) in the anode.

FIG. 4 is a perspective view showing the typical structure of the first and second anode components 24 and 25 constituting the anode 250. The anode components 24 and 25 are arranged parallel to the last-stage dynode 26 and kept at a potential higher than that of the dynode 26. The anode component 24 or 25 has a structure wherein a plurality of long metal plates 24*a* or 25*a* electrically insulated from each other are one-dimensionally aligned. The alignment direction of the first anode component 24 (X direction) and the alignment direction of the second anode component 25 (Y direction) are perpendicular to each other. Each of the metal plates 24*a* or 25*b* has the plurality of rectangular through holes 24*b* or 25*b* formed in a line. Secondary electrons emitted from the dynode plates 23 pass through the through holes 24*b* and 25*b* to reach the inverting dynode 26. The secondary electrons inverted by the dynode 26 are captured at a predetermined portion of the first and second anode components 24 and 25.

The metal plates 24*a* of the first anode component 24 and the metal plates 25*a* of the second anode component 25 are connected to predetermined portions of resistor chains 27 outside the photomultiplier through the corresponding lead pins 150.

Figure 1:
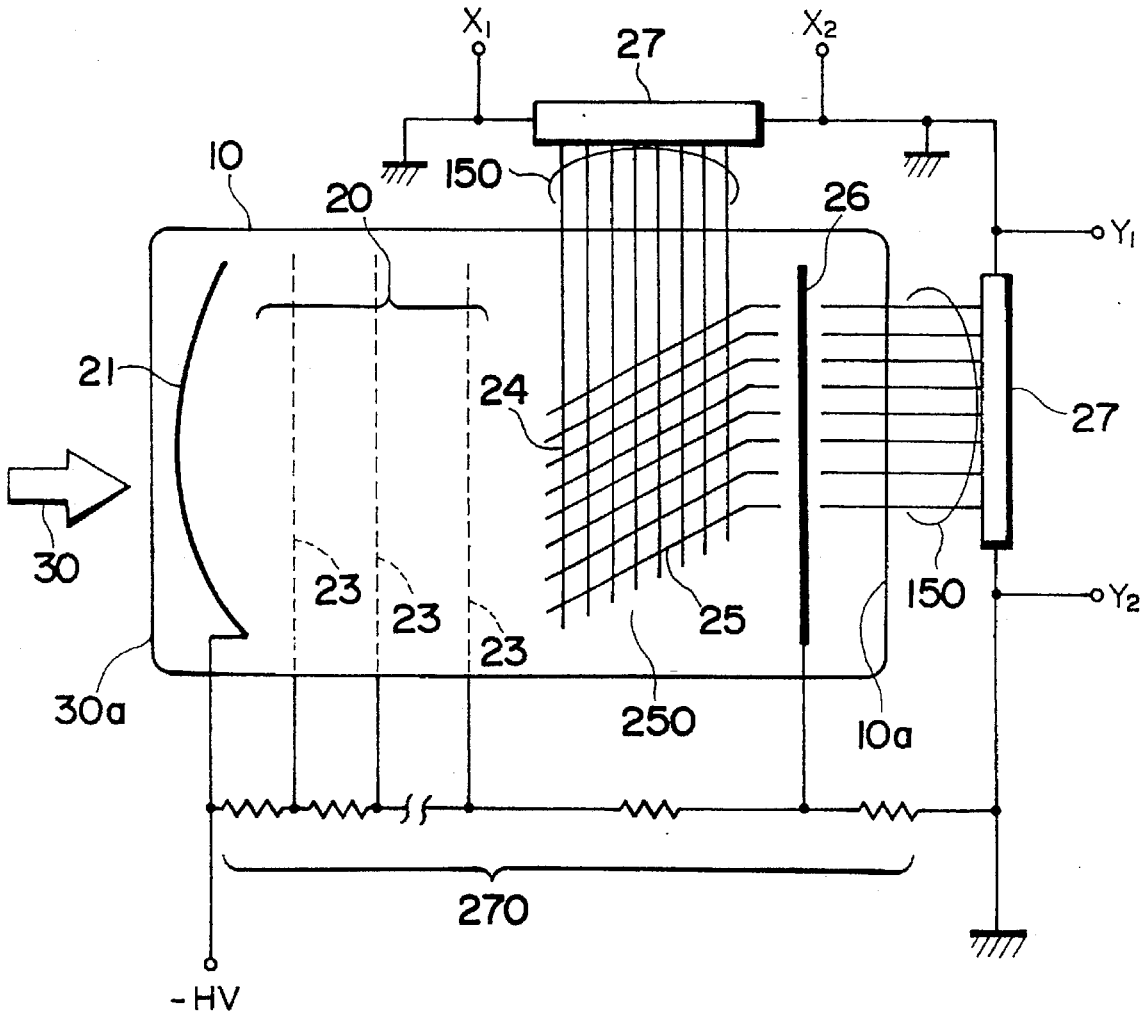
FIG. 1 is a view showing an overall arrangement including a position sensitive photomultiplier according to the present invention.
Figure 2:
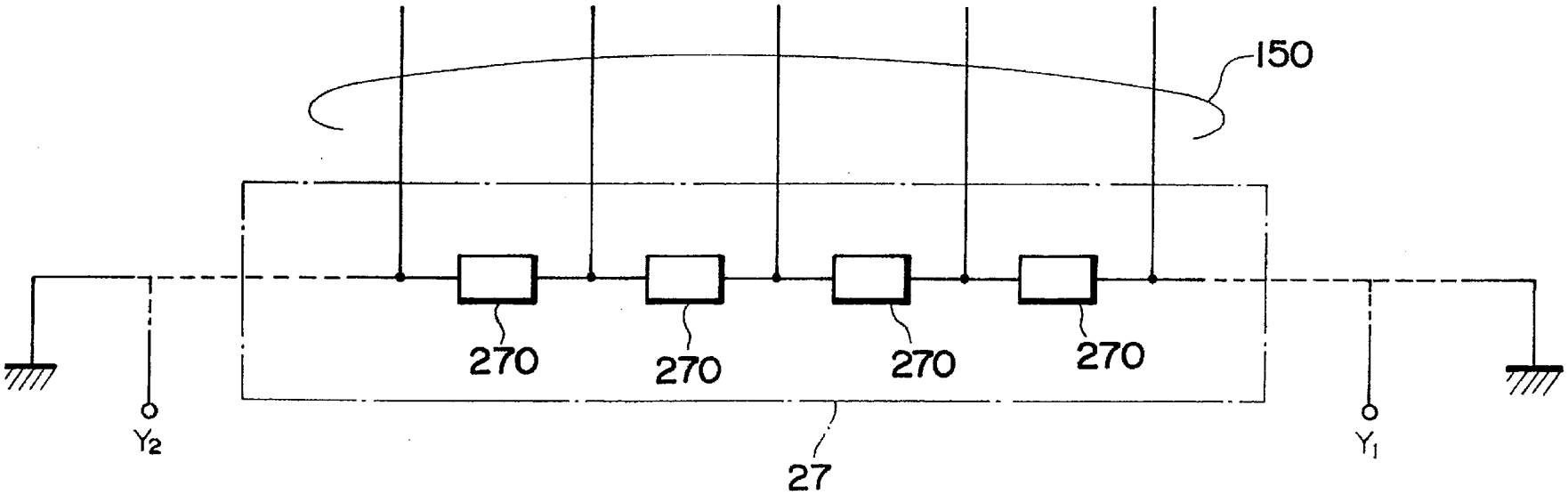
FIG. 2 is a view showing the arrangement of a resistor chain for extracting an electrical signal corresponding to the capture position of multiplied secondary electrons from an anode shown in FIG. 1.

FIG. 2 is a view showing the arrangement of the resistor chain 27. The resistor chain 27 consists of a plurality of resistors 270 connected in series. Each lead pin 150 having one end connected to a corresponding metal plate is connected to a corresponding portion (between the resistors 270).

Therefore, the secondary electrons captured by the first anode component 24 and the second anode component 25 and extracted from the photomultiplier through the lead pins 150 are shunted through the resistor chains 27 and extracted from terminals $X_1$ and $X_2$ and terminals $Y_1$ and $Y_2$. An adder 28 and a divider 29 are connected to the terminals so that the position of the center of gravity can be obtained on the basis of the following equations:

$$X=X_2/(X_1+X_2)$$

$$Y=Y_2/(Y_1+Y_2)$$

Note that a mechanism for detecting the incident position of an incident light beam in the X and Y directions is described in, e.g., "POSITION SENSITIVE PHOTOMULTIPLIER TUBE FOR SCINTILLATION IMAGING" (NSS, 1986).

Figure 5:
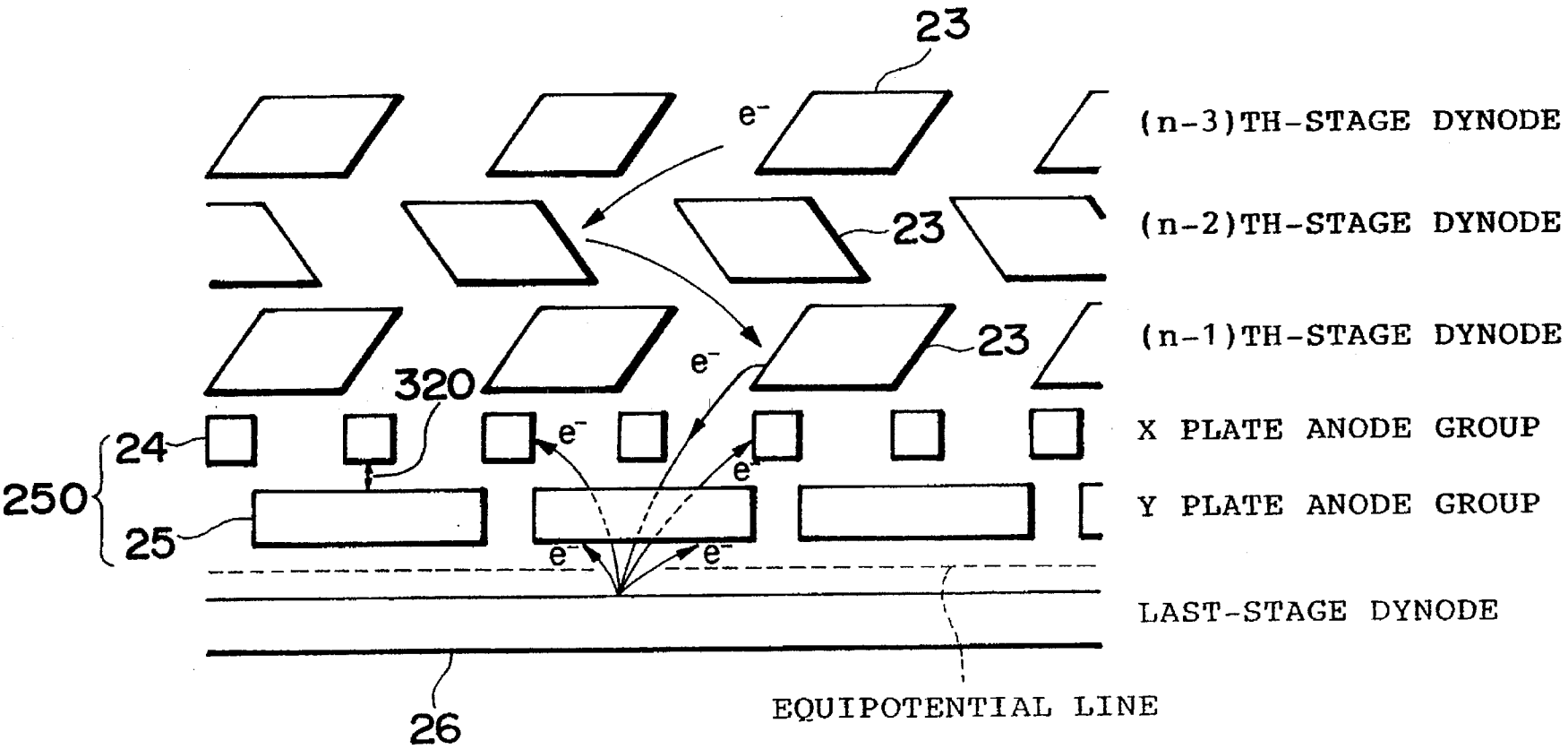
FIG. 5 is a view for explaining the concept of a secondary electron capture mechanism in the anode shown in FIG. 4.

The plate-like first and second anode components 24 and 25 are arranged in place of a conventional wire anode disclosed in the above prior art. As shown in FIG. 5, these anode components 24 and 25 have a larger surface area than that of the wire anode because of having a flat surface in parallel to an electron-emitting surface of the dynode 26. In particular, in this figure, the first anode component 24 means the X plate anode group, and the second anode component 25 means the Y plate anode group. For this reason, distortion in an equipotential line shown in FIG. 5 can be minimized, and a high field intensity can be obtained. Most of the secondary electrons emitted from the dynode 26 are collected by the metal plates 24*a* and 25*a* relatively close to the emission position. The secondary electrons are rarely collected by the metal plates 24*a* and 25*a* far from the emission position because of stray of the secondary electrons. Therefore, crosstalk caused by stray of the secondary electrons is minimized to improve the precision of position resolving power. In addition, the high field intensity can prevent space-charges from being generated, resulting in good linear characteristics. Furthermore, the field intensity is high between the inverting dynode 26 and the anode 250 while a parallel field is formed therebetween to almost prevent the secondary electrons from straying, resulting in good time characteristics.

Figure 6:
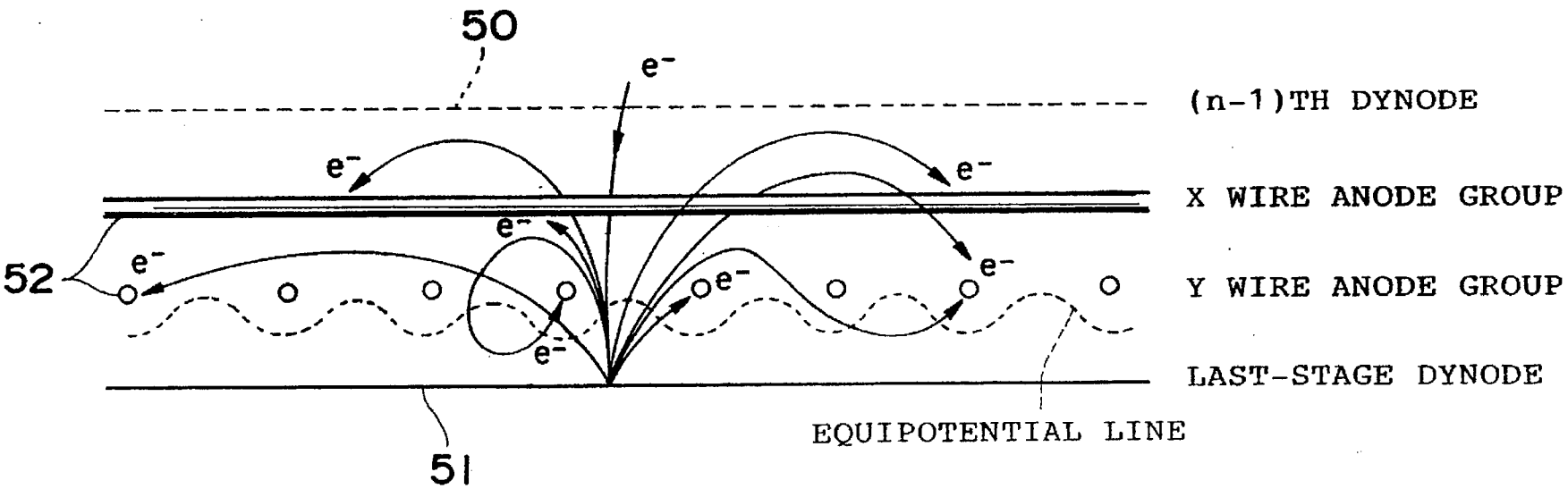
FIG. 6 is a view for explaining a secondary electron capture mechanism in an anode consisting of a plurality of wires, as a comparative example.

FIG. 6 is a view showing the structure of the wire anode disclosed in the above prior art, as a comparative example. Referring to FIG. 6, reference numeral 50 denotes an (n−1)th-stage dynode; 52, wires constituting an X wire anode group for detecting the electron capture position in the X direction and a Y wire anode group for detecting the electron capture position in the Y direction; and 51, an inverting dynode at the last stage (last-stage dynode).

In the wire anode shown in FIG. 6, the space ratio is high, and the equipotential line is distorted. Since reflected secondary electrons emitted from the last-stage dynode 51 (inverting dynode) are diffused in a wide range, it is likely that a plurality of secondary electrons emitted from one position of the dynode 51 are extracted from different portions of the anode. This may cause crosstalk to degrade the precision of position resolving power and also increase distortion in the periphery.

Figure 7:
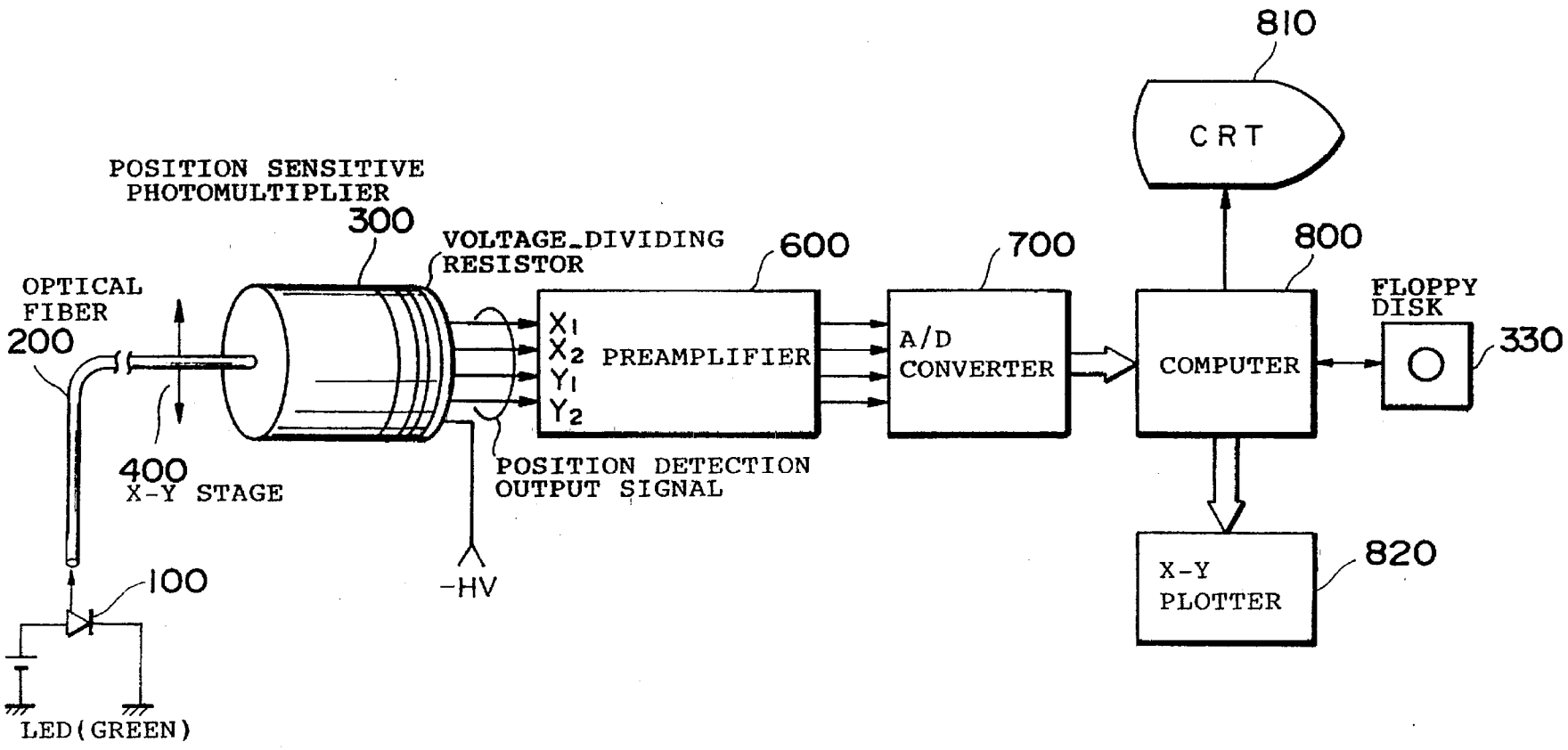
FIG. 7 is a view showing the arrangement of a measurement system prepared for measurement of the precision of position resolving power of the photomultiplier shown in FIGS. 1 and 3.

A measurement system for measuring the position resolving power of the photomultiplier will be described below with reference to FIGS. 7 and 8.

An LED is used as a light source 100. A light beam irradiated from this LED emerges to a photomultiplier 300 through an optical fiber 200. At this time, the distal end portion of the optical fiber 200 is fixed to an X-Y stage 400 so as to freely select the incident position on the photomultiplier 300.

A predetermined voltage is applied from a voltage-dividing resistor 500 to each dynode.

The detected electrical signals $X_1$, $X_2$, $Y_1$, and $Y_2$ are amplified by a preamplifier 600, A/D-converted, and supplied to a computer 800 for calculating the incident position. A CRT 810 and an X-Y plotter 820 serving as a display means, and a disk driver serving as a recording means (measurement data is recorded on a floppy disk 330) are connected to the computer 800.

Figure 8:
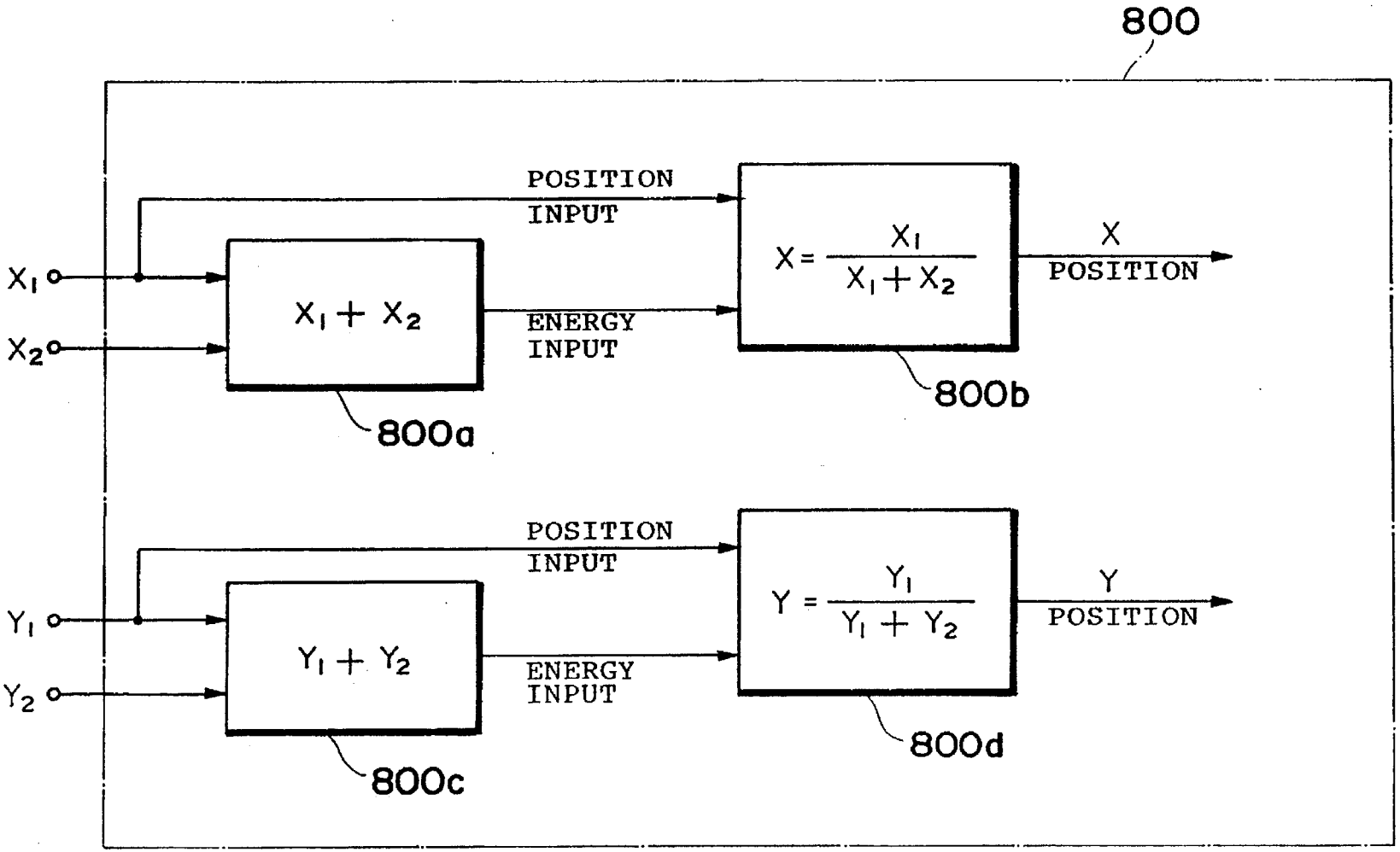
FIG. 8 is a block diagram showing the arrangement of a position detection signal processing means in the measurement system shown in FIG. 7.

In the computer 800, as shown in FIG. 8, the detected signals $X_1$ and $X_2$ are added by an adder 800*a*, and thereafter, the signal $X_1$ is divided by an output $(X_1+X_2)$ from the adder 800*a* by a divider 800*b*, thereby calculating the incident position of the incident light in the X direction.

On the other hand, the detected signals $Y_1$ and $Y_2$ are added by an adder 800*c*, and thereafter, the signal $Y_1$ is divided by an output $(Y_1+Y_2)$ from the adder 800*c* by a divider 800*d*, thereby calculating the incident position of the incident light in the Y direction.

A method of fixing the first and second anode components 24 and 25 constituting the anode 250 in the vacuum vessel 10 will be described with reference to FIGS. 9 to 15.

Figure 9:
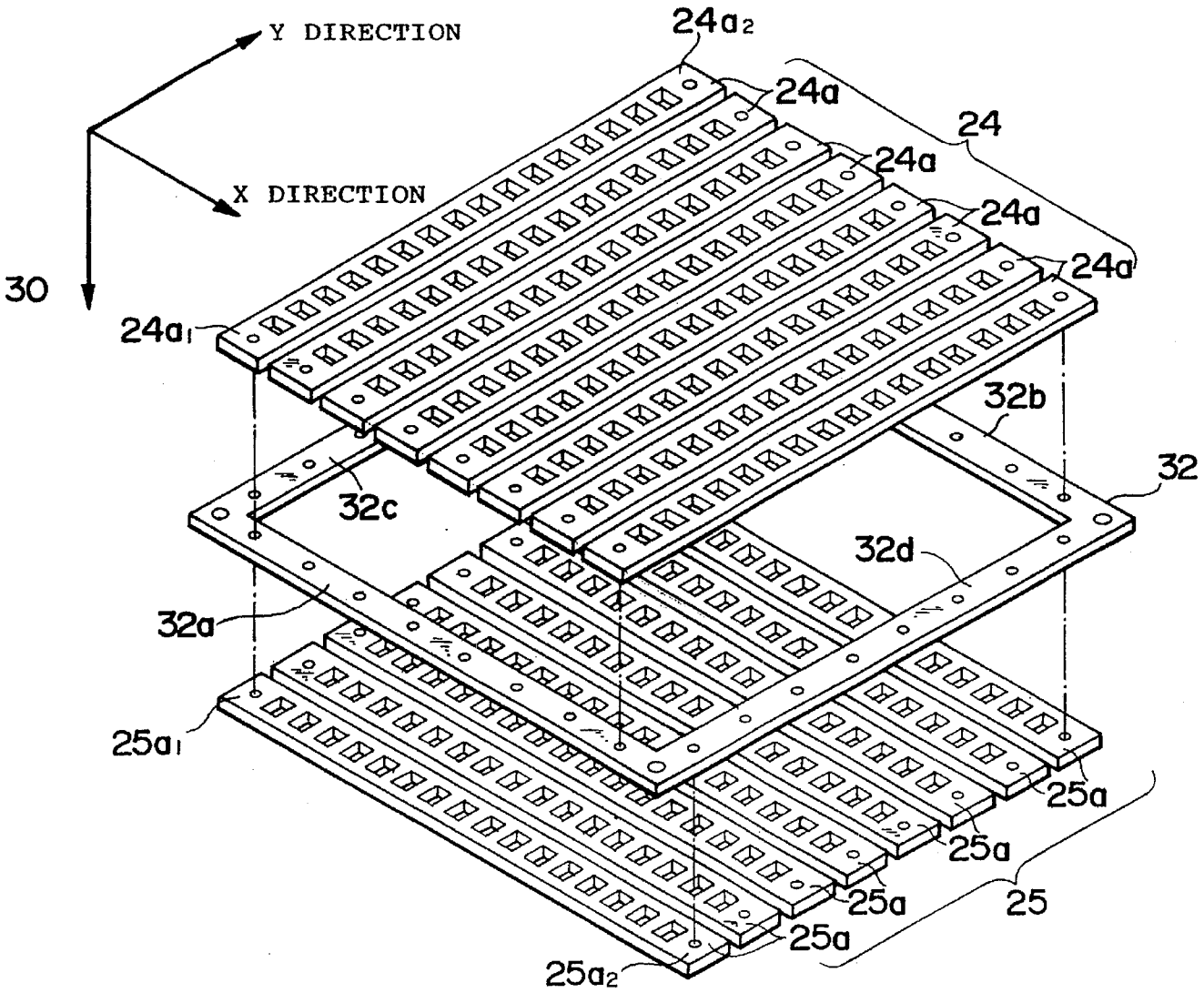
FIG. 9 is a perspective view for explaining the one manufacturing steps of an anode according to the first embodiment.

FIG. 9 is a perspective view showing the manufacturing steps of the anode 250 constituted by the first and second anode components 24 and 25 attached to a ceramic frame 32. The first anode component 24 is attached on the upper surface of the ceramic frame 32 while the second anode component 25 is attached on the lower surface of the ceramic frame 32.

Note that the ceramic frame 32 has four sides 32*a* to 32*d*. A first end portion $24a_1$ of each metal plate 24*a* of the first anode component 24 is fixed to the first side 32*a* while a second end portion $24a_2$ of the metal plate 24*a* is fixed to the second side 32*b*. On the other hand, a first end portion $25a_1$ of each metal plate 25*a* of the second anode component 25 is fixed to the third side 32*c* while a second end portion $25a_2$ of the metal plate 25*a* is fixed to the fourth side 32*d*.

As shown in FIG. 9, eight through holes are formed in each side of the ceramic frame 32 at an equal interval. Through holes are formed at the two ends of each of the metal plates 24*a* and 25*a*. The metal plates 24*a* are aligned with the through holes matching each other, and fixed on the upper surface of the ceramic frame 32 with eyelets. Similarly, the metal plates 25*a* are aligned with the through holes matching each other, and fixed on the lower surface of the ceramic frame 32 with eyelets. The metal plates 24*a* and 25*a* are electrically insulated from each other by the ceramic frame 32.

Figure 10:
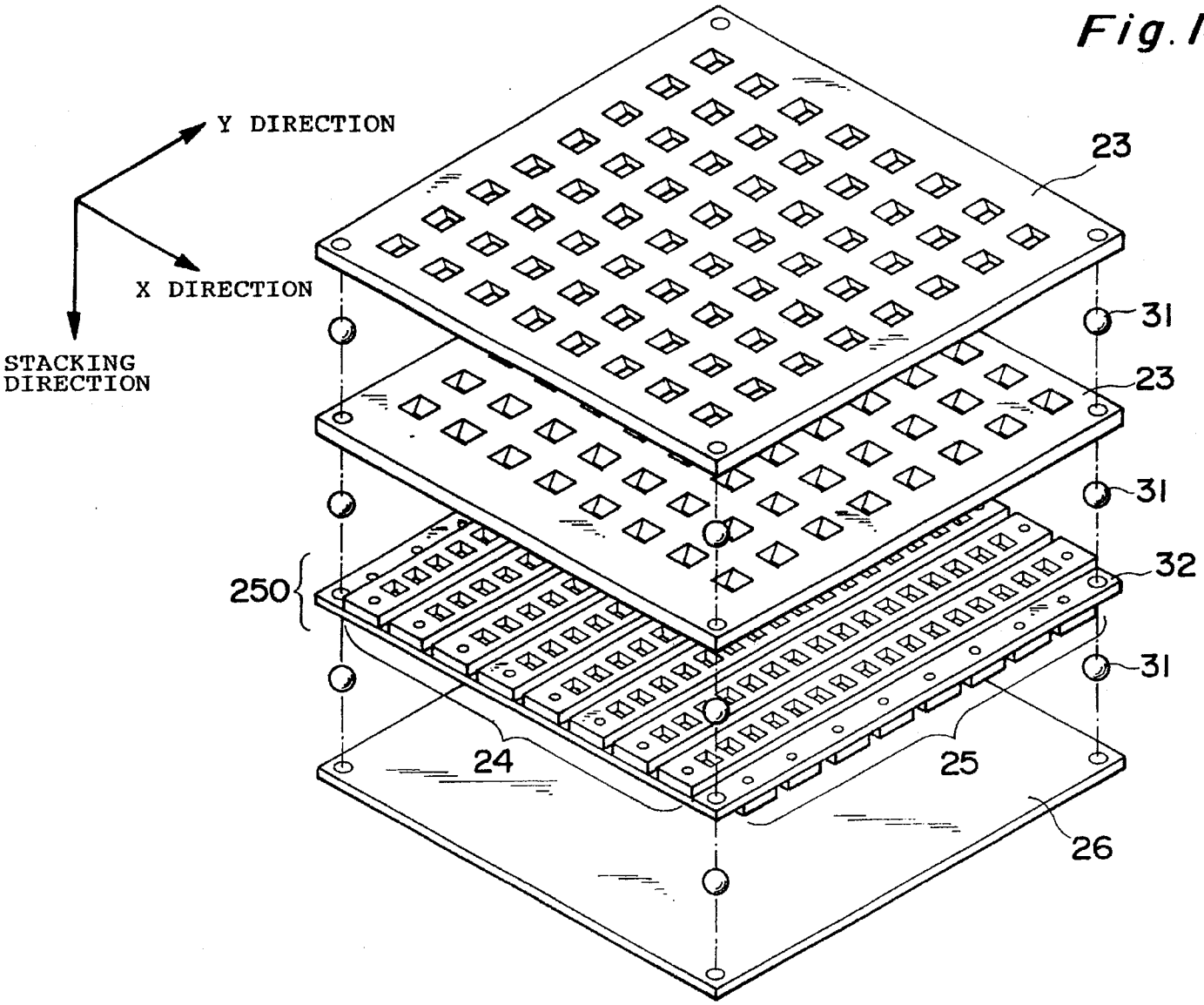
FIG. 10 is a perspective view showing the assembling steps of the photomultiplier including the anode according to the first embodiment.

FIG. 10 is a perspective view showing the anode 250 having the above structure.

Through holes having tapered surfaces are formed near the four apices of the ceramic frame 32. The ceramic frame 32 is stacked on the dynode 26 at a predetermined interval through insulating balls 31. In this figure, the stacking direction of the dynodes 23 corresponds to the incident direction 30 of the light beam.

Figure 11:
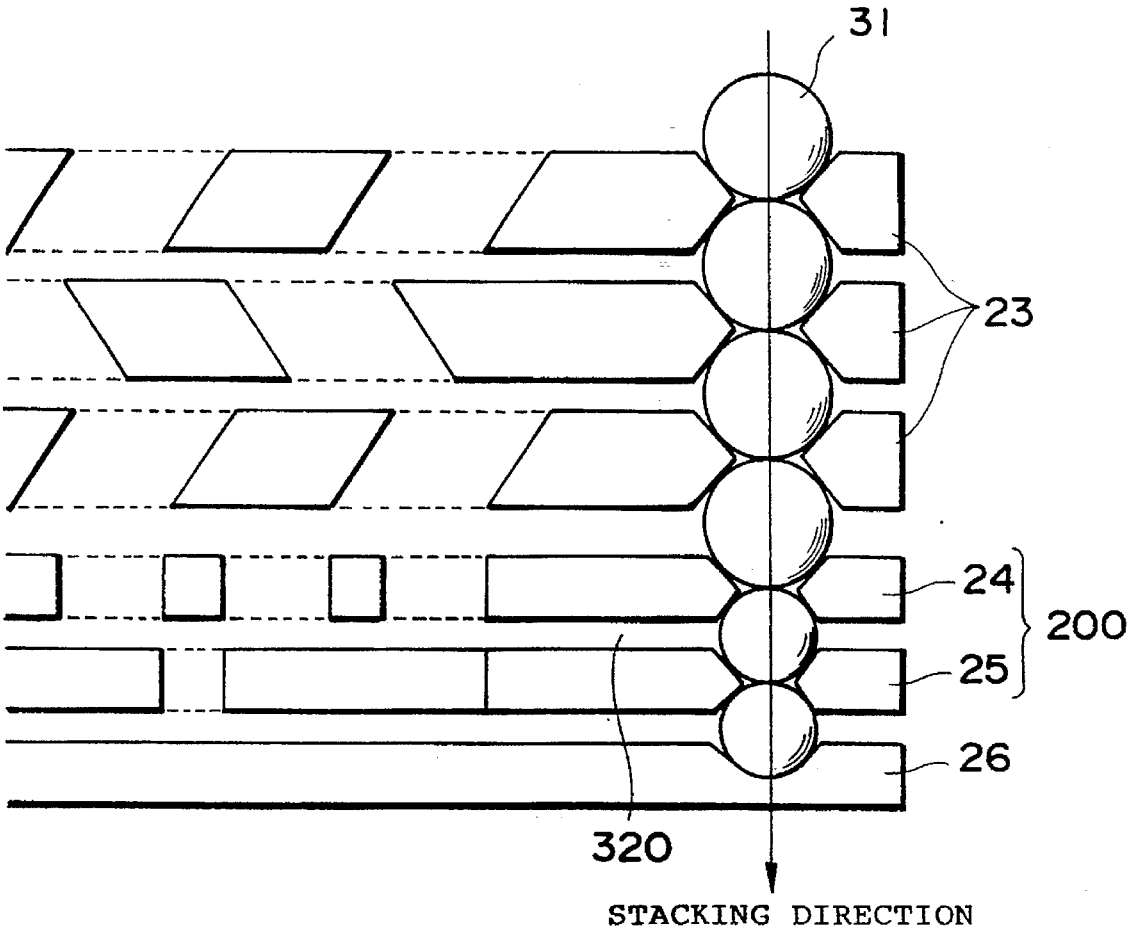
FIG. 11 is a sectional view showing the multilayered structure of the photomultiplier constituted by dynodes and an anode by using insulating balls.

FIG. 11 is a sectional view showing the multilayered structure of the dynodes 23 and 26 and the anode 250 stacked as shown in FIG. 10.

Figure 12:
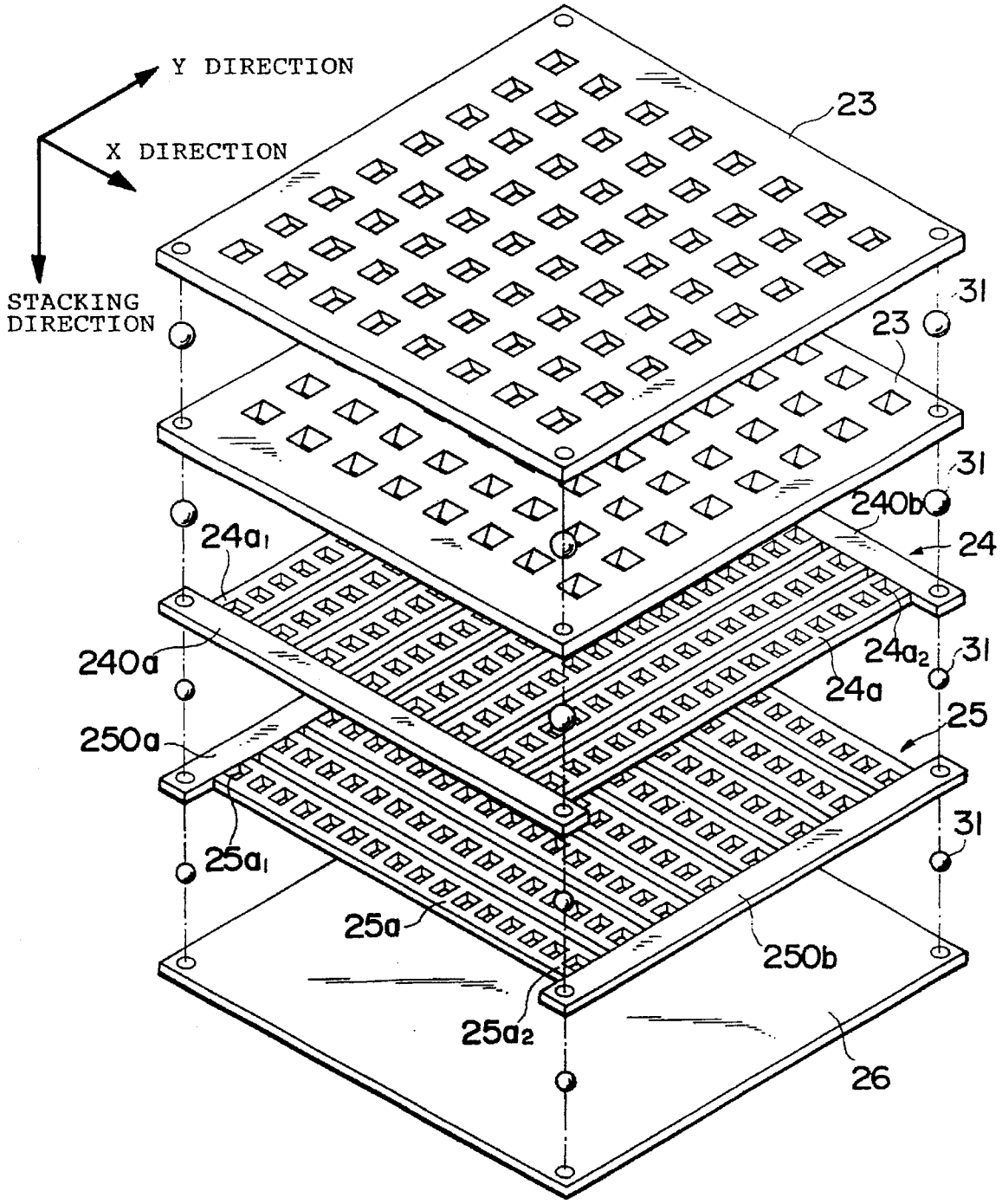
FIG. 12 is a perspective view for explaining another manufacturing steps of the anode according to the first embodiment.

FIG. 12 is a perspective view showing steps in manufacturing the anode 250 by using independent fixing frames (insulating bars).

For the first anode component 24, the eight metal plates 24*a* are parallelly aligned, and the first end portion $24a_1$ and the second end portion $24a_2$ of each of the metal plates 24*a* are attached to a first insulating bar 240*a* and a second insulating bar 240*b*, respectively. Similarly, for the second anode component 25, the eight metal plates 25*a* are parallelly aligned, and the first end portion $25a_1$ and the second end portion $25a_2$ of each of the metal plates 25*a* are attached to a third insulating bar 250*a* and a fourth insulating bar 250*b*, respectively.

Through holes having tapered surfaces are formed near the four apices of each of the dynodes 23 and 26 and at the two ends of each of the four fixing frames (insulating bars 240*a*, 240*b*, 250*a*, and 250*b*). Insulating balls are placed at the positions of the through holes, positioned, and supported. For this reason, as shown in FIG. 11, the dynodes 23 and 26 and the anode components 24 and 25 are stacked at predetermined intervals, and these layers are electrically insulated from each other.

Figure 13:
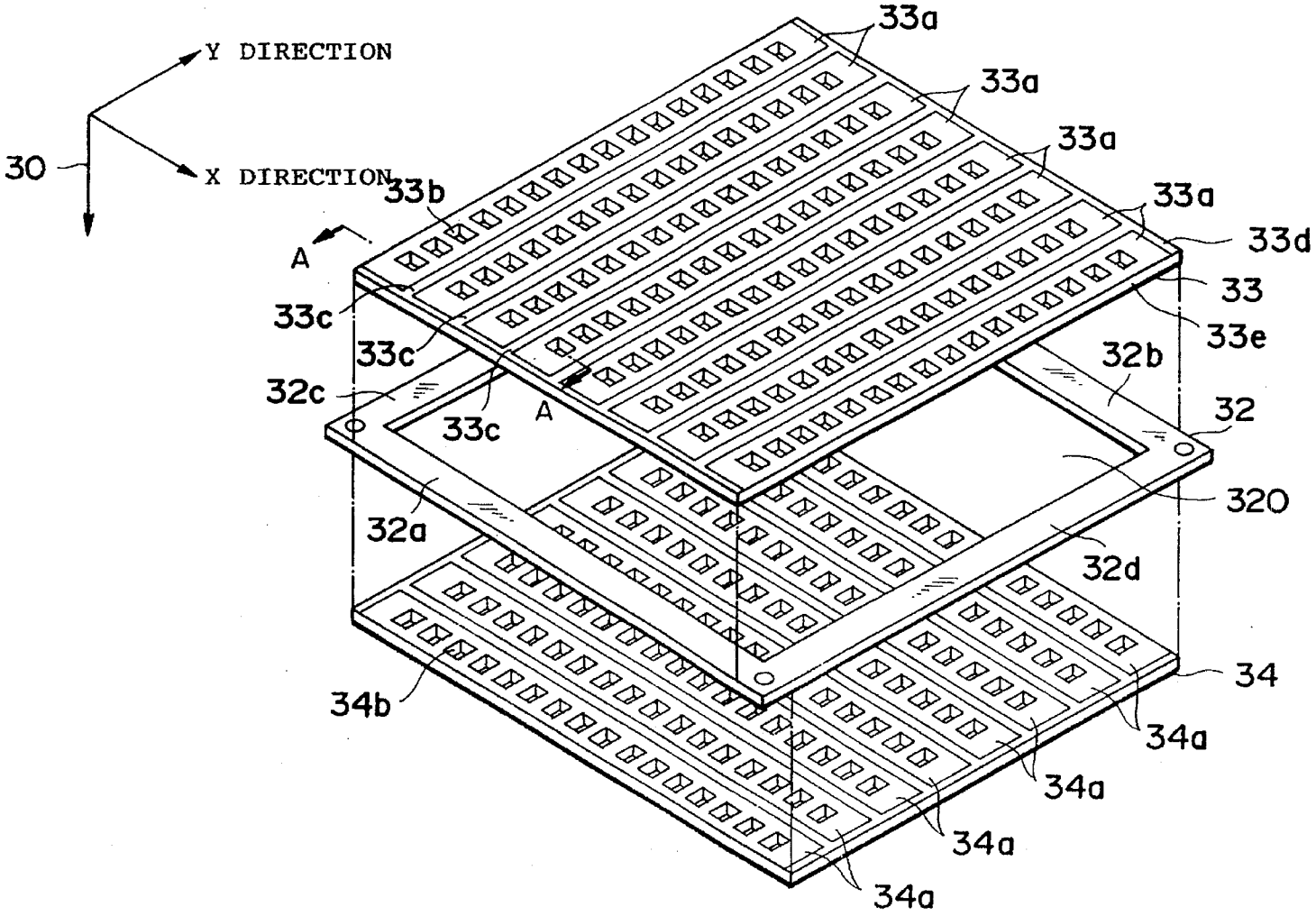
FIG. 13 is a perspective view for explaining the manufacturing steps of an anode according to the second embodiment.
Figure 15:
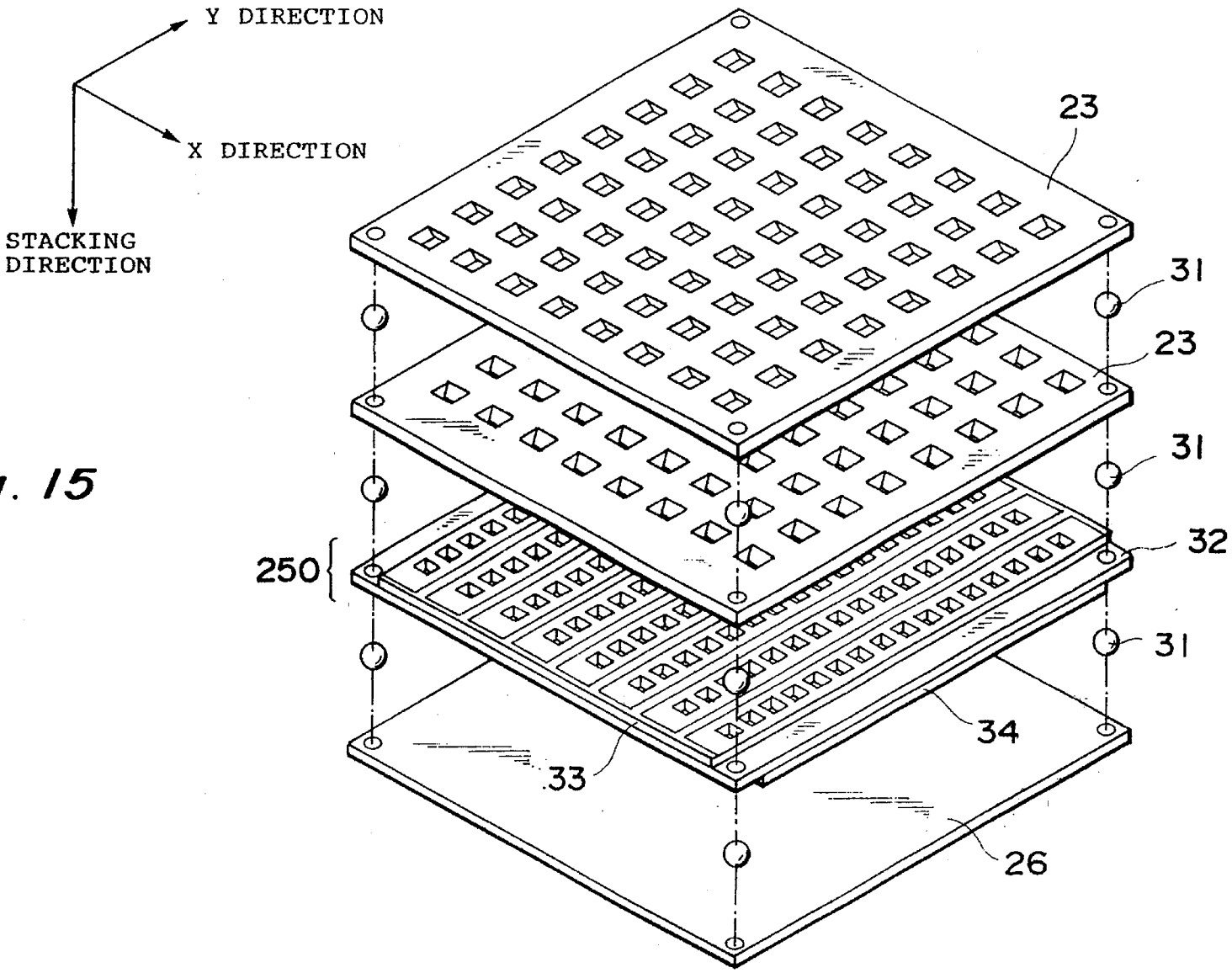
FIG. 15 is a perspective view showing the assembling steps of the photomultiplier including the anode according to the second embodiment.

FIG. 13 is a perspective view showing steps in manufacturing an anode 250 by bonding a first insulating plate 33 and a second insulating plate 33, each having a plurality of strip anodes (conductive thin films) deposited on the upper and lower surfaces, to a ceramic frame 32. The first insulating plate 33 is bonded to the upper surface of the ceramic frame 32 while the second insulating plate 34 is bonded to the lower surface of the ceramic frame 32. Through holes having tapered surfaces are formed near the four apices of the ceramic frame 32, and the ceramic frame 32 is stacked on the dynode 26 at a predetermined interval through insulating balls 31, as shown in FIG. 15.

As shown in FIG. 13, for a first anode component 24, eight strip anode regions 33*a* are parallelly aligned on the upper and lower surfaces 33*d*, 33*e* of the first insulating plate 33. A metal such as Al (aluminum) is deposited en the anode regions 33*a*. A plurality of rectangular anode holes 33*b* for passing secondary electrons are formed in a line in each anode region 33*a*. Similarly, for a second anode component 25, a plurality of anode regions 34*a* each having through holes 34*b* formed in a line are aligned on the upper and lower surfaces 34*d*, 34*e* of the second insulating plate 34. The first insulating plate 33 and the second insulating plate 34 are formed of a material such as a ceramic or glass.

Figure 14:
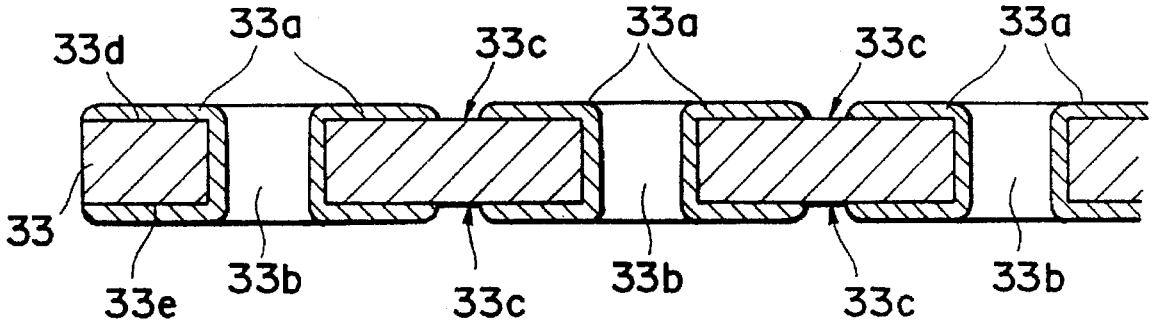
FIG. 14 is a sectional view showing the structure of an anode component along A—A line in FIG. 13.

FIG. 14 shows a sectional view showing the structure of the first insulating plate 33 along A—A line in FIG. 13. As shown in FIG. 14, the thin Al films of the first anode component 24 cover the entire side walls of the through holes 33*b*, thereby electrically connecting an upper surface 33*d* to a lower surface 33*e* of the first insulating plate 33. To electrically insulate the anode regions 33*a* from each other, insulating regions 33*c* to which the surface of the first insulating plate 33 is exposed are formed between the thin Al films.

The second anode component 25 also has the same structure.

The two ends of the first insulating plate 33 are bonded to the upper surface of the ceramic frame 32 while the two ends of the second insulating plate 34 are bonded to the lower surface of the ceramic frame 32, thereby fixing the insulating plates. To fix the insulating plates, the alignment direction of the anode regions 33*a* of the first insulating plate 33 (X direction) is set to be perpendicular to the alignment direction of the anode regions 34*a* of the second insulating plate 34 (Y direction). With this arrangement, two-dimensional position detection can be performed.

The present invention is not limited to the above embodiments, and various changes and modifications can also be made.

The through holes 24*b* and 25*b*, or 33*b* and 34*b* may have another shape other than the rectangular shape, e.g., a circular or triangular shape.

Calculation of the position of the center of gravity may be performed through hardware using the adder 28 and the divider 29, or through software such that currents output from the terminals $X_1$, $X_2$, $Y_1$, and $Y_2$ are supplied to a predetermined computer through an A/D converter or the like.

In place of the ceramic frame 32, an insulating frame consisting of glass or rubber may also be used.

As has been described in detail, according to the photomultiplier of the present invention, most of the plurality of electrons emitted from the inverting dynode are captured by the anode or anode regions at a portion close to the emission position. For this reason, the incident position of the electrons can be detected at a high position resolving power while minimizing the crosstalk. Particularly, since the anode component of the present invention has a large surface area for capturing the electrons, distortion in equipotential line can be minimized, and a high field intensity can be obtained. Therefore, the linear characteristics and the time characteristics can be improved.

From the invention thus described, it will be apparent that various alternative arrangements of the invention are possible. Such arrangements are not to be regarded as a departure from the spirit and scope of the invention, and all such modifications as would be obvious to one skilled in the art are intended for inclusion within the scope of the following claims.

What is claimed is:

1. A photomultiplier comprising:

a photocathode for emitting photoelectrons corresponding to an incident weak light beam;

a dynode unit, constituted by stacking a plurality of dynodes, for multiplying the photoelectrons emitted from said photocathode; and an anode provided between said dynode unit and a bottom portion of said photomultiplier, for detecting an incident position of an incident plane where the weak light beam is reached, said anode having a first anode component for detecting the incident position of the incident plane in a first direction and a second anode component for detecting the incident position of the incident plane in a second direction perpendicular to the first direction, wherein said first anode component has a plurality of through holes for passing at least some of the secondary electrons emitted from said dynode unit, a first flat surface opposing said dynode unit, and a second flat surface on opposite side of said first surface, and said second anode component has a first flat surface opposing said second surface of said first anode component and a second flat surface on opposite side of said first surface of said second anode component.

2. A photomultiplier according to claim 1, wherein said first anode component and said second anode component are set at an equal potential and separated from each other by a predetermined distance through an insulating member.

3. A photomultiplier according to claim 1, wherein said first anode component has a plurality of metal plates aligned in the first direction at a predetermined interval and extending in the second direction, each of said metal plates having the plurality of through holes aligned in a line in the second direction, and said second anode component has a plurality of metal plates aligned in the second direction at a predetermined interval and extending in the first direction, each of said metal plates extending in a line in the first direction.

4. A photomultiplier according to claim 3, wherein said anode further has a frame provided between said first anode component and said second anode component and consisting of an insulating material, said frame having at least a first side, a second side opposing said first side, and third and fourth sides opposing each other and communicating with said first and second sides.

5. A photomultiplier according to claim 3, wherein said anode has first and second insulating bars, provided between said first anode component and said second anode component, for fixing said plurality of metal plates of said first anode component, which are aligned in the first direction at the predetermined interval, such that a first end portion of each of said metal plates of said first anode component is fixed to said first insulating bar and a second end portion is fixed to said second insulating bar, and third and fourth insulating bars, provided between said first anode component and said second anode component, for fixing said plurality of metal plates of said second anode component, which are aligned in the second direction at the predetermined interval, such that a first end portion of each of said metal plates of said second anode component is fixed to said third insulating bar and a second end portion is fixed to said fourth insulating bar.

6. A photomultiplier according to claim 1, wherein said first anode component has a first insulating plate having the through holes for passing at least some of the secondary electrons emitted from said dynode unit, and a plurality of first conductive thin films disposed on a surface of said first insulating plate, extending in the second direction, and aligned in the first direction at a predetermined interval, and said second anode component has a second insulating plate separated from said first insulating plate by a predetermined interval, and a plurality of second conductive thin films, disposed on a surface of said second insulating plate, extending in the first direction, and aligned in the second direction at a predetermined interval.

7. A photomultiplier according to claim 6, wherein said anode further has a frame provided between said first anode component and said second anode component and consisting of an insulating material, said frame having at least a first side, a second side opposing said first side, and third and fourth sides opposing each other and connected to said first and second sides.

8. A photomultiplier according to claim 6, wherein each of said first conductive thin films which extend in the second direction covers entire inner walls of the through holes of said first insulating plate, the through holes being located in a region on where said first conductive thin film is disposed, and each of said second conductive thin films which extend in the first direction covers entire inner walls of the through holes of said second insulating plate, the through holes being located in a region on where said second conductive thin film is disposed.

9. A photomultiplier comprising:

a photocathode for emitting photoelectrons corresponding to an incident weak light beam;

a dynode unit, arranged between said photocathode and a bottom portion of said photomultiplier, for multiplying the photoelectrons emitted from said photocathode, said dynode unit being constituted by stacking a plurality of dynode plates, each of which supports at least one dynode, along an incident direction of the photoelectrons;

an anode for detecting an incident position of an incident plane where the weak light beam is reached, said anode being provided between said dynode unit and said bottom portion of said photomultiplier, set at a potential higher than that of any one of said dynode plates, and having a first anode component for detecting the incident position of the incident plane in a first direction and a second anode component for detecting the incident position of the incident plane in a second direction perpendicular to the first direction, said first anode component having through holes for passing secondary electrons multiplied by said dynode unit, a first surface opposing said dynode unit, and a second flat surface on an opposite side of said first surface, and said second anode component being arranged between said first anode component and said bottom portion of said photomultiplier at a position separated from said first anode component by a predetermined interval, having through holes for passing the secondary electrons passing through said first anode component, a first surface opposing said second surface of said first anode component, and a second flat surface on an opposite side of said first surface of said second anode component; and an inverting dynode, arranged between said anode and said bottom portion of said photomultiplier and set at a potential lower than that of said anode, for receiving the secondary electrons passing through the through holes of said anode and emitting the secondary electrons toward said anode.

10. A photomultiplier according to claim 9, wherein said second flat surface of said first anode component is arranged parallel to said inverting dynode, and said second flat surface of said second anode component is arranged parallel to said inverting dynode.

11. A photomultiplier according to claim 9, wherein said first anode component and said second anode component are set at an equal potential and separated from each other by a predetermined distance through an insulating member.

12. A photomultiplier according to claim 9, wherein said first anode component has a plurality of metal plates aligned in the first direction at a predetermined interval and extending in the second direction, each of said metal plates having the plurality of through holes arranged in a line in the second direction, and said second anode component has a plurality of metal plates aligned in the second direction at a predetermined interval and extending in the first direction, each of said metal plates having the plurality of through holes arranged in a line in the first direction.

13. A photomultiplier according to claim 12, wherein said anode has a frame provided between said first anode component and said second anode component and consisting of an insulating material, said frame having at least a first side, a second side opposing said first side, and third and fourth sides opposing each other and communicating with said first and second sides.

14. A photomultiplier according to claim 12, wherein said anode has first and second insulating bars, provided between said first anode component and said second anode component, for fixing said plurality of metal plates of said first anode component, which are aligned in the first direction at the predetermined interval, such that a first end portion of each of said metal plates of said first anode component is fixed to said first insulating bar and a second end portion is fixed to said second insulating bar, and third and fourth insulating bars, provided between said first anode component and said second anode component, for fixing said plurality of metal plates of said second anode component, which are aligned in the second direction at the predetermined interval, such that a first end portion of each of said metal plates of said second anode component is fixed to said third insulating bar and a second end portion is fixed to said fourth insulating bar.

15. A photomultiplier according to claim 9, wherein said first anode component has a first insulating plate having the plurality of through holes for passing the secondary electrons emitted from said dynode unit, and a plurality of first conductive thin films disposed on a surface of said first insulating plate, extending in a second direction, and aligned in a first direction at a predetermined interval, and said second anode component has a second insulating plate having the plurality of through holes for passing the secondary electrons emitted from said dynode unit, and a plurality of second conductive thin films disposed on a surface of said second insulating plate, extending in the first direction, and aligned in the second direction at a predetermined interval.

16. A photomultiplier according to claim 15, wherein said anode further has a frame provided between said first anode component and said second anode component and consisting of an insulating material, said frame having at least a first side, a second side opposing said first side, and third and fourth sides opposing each other and communicating with said first and second sides.

17. A photomultiplier according to claim 15, wherein each of said first conductive thin films which extend in the second direction covers entire inner walls of the through holes of said first insulating plate, the through holes being located in a region on where said first conductive thin film is disposed, and each of said second conductive thin films which extending in the first direction covers entire inner walls of the through holes of said second insulating plate, the through holes being located in a region on where said second conductive thin film is disposed.

18. An anode, applied to a photomultiplier for receiving an incident weak light beam and extracting an electrical signal corresponding to the weak light beam, for detecting an incident position of an incident plane where the weak light beam is reached, comprising:

a first anode component for detecting the incident position of the incident plane in a first direction, said first anode component having a plurality of metal plates aligned in a first direction at a predetermined interval and extending in a second direction perpendicular to the first direction, each of said metal plates having a flat surface along the second direction and a plurality of through holes arranged in a line in the second direction;

a second anode component for detecting the incident position of the incident plane in the second direction, said second anode component having a plurality of metal plates aligned in the second direction at a predetermined interval and extending in the first direction, each of said metal plates having a flat surface along the first direction and a plurality of through holes arranged in a line in the first direction; and an insulating member, provided between said first anode component and said second anode component, for separating said first anode component from said second anode component by a predetermined distance, said first anode component and said second anode component being set at an equal potential.

19. An anode according to claim 18, wherein said insulating member is an insulating frame comprising a first side to which a first end portion of each of said metal plates of said first anode component is fixed, a second side opposing said first side, to which a second end portion of each of said metal plates of said first anode component is fixed, a third side connected to said first side and said second side, to which a first end portion of each of said metal plates of said second anode component is fixed, and a fourth side connected to said first side and said second side, to which a second end portion of each of said metal plates of said second anode component is fixed, whereby an air gap is between said first anode component and said second anode component and defined as a space surrounded by said sides and defined.

20. An anode according to claim 18, wherein said insulating member has first and second insulating bars, provided between said first anode component and said second anode component, for fixing said plurality of metal plates of said first anode component, which are aligned in the first direction at the predetermined interval, such that a first end portion of each of said metal plates of said first anode is fixed to said first insulating bar, and a second end portion is fixed to said second insulating bar, and third and fourth insulating bars, provided between said first anode component and said second anode component, for fixing said plurality of metal plates of said second anode component, which are aligned in the second direction at the predetermined interval, such that a first end portion of each of said metal plates of said second anode component is fixed to said third insulating bar and a second end portion is fixed to said fourth insulating bar, whereby a first end portion of said first insulating bar is fixed to a first end portion of said third insulating bar, a second end portion of said first insulating bar is fixed to a first end portion of said fourth insulating bar, a first end portion of said second insulating bar is fixed to a second end portion of said third insulating bar, and a second end portion of said second insulating bar is fixed to a second end portion of said fourth insulating bar.

21. An anode, applied to a photomultiplier for receiving an incident weak light beam and extracting an electrical signal corresponding to the weak light beam, for detecting an incident position of an incident plane where the weak light beam is reached, comprising:

a first anode component for detecting the incident position of the incident plane in a first direction, said first anode component having a first insulating plate having a plurality of through holes, and a plurality of first conductive thin films disposed on a surface of said first insulating plate, extending in a second direction perpendicular to the first direction, and aligned in the first direction at a predetermined interval, a second anode component for detecting the incident position of the incident plane in the second direction, said second anode component having a second insulating plate having a plurality of through holes, and a plurality of second conductive thin films formed on a surface of said second insulating plate, extending in the first direction, and aligned in the second direction at a predetermined interval; and an insulating member, provided between said first anode component and said second anode component, for separating said first anode component from said second anode component by a predetermined distance, said first anode component and said second anode component being set at an equal potential.

22. An anode according to claim 21, wherein said insulating member is an insulating frame comprising a first side on a first end portion side of said first conductive thin film, to which a first end portion of said first insulating plate is fixed, a second side on a second end portion side of said first conductive thin film to oppose said first side, to which a second end portion of said first insulating plate is fixed, a third side on a first end portion side of said second conductive thin film to be connected to said first side and said second side, to which a first end portion of said second insulating side is fixed, and a fourth side on a second end portion side of said second conductive thin film to be connected to said first side and said second side, to which a second end portion of said second insulating plate is fixed, whereby an air gap is between said first anode component and said second anode component and defined as a space surrounded by said sides.

23. An anode according to claim 21, wherein each of said first conductive thin films which extend in the second direction covers entire inner walls of the through holes of said first insulating plate, the through holes being located in a region on where said first conductive thin film is disposed, and each of said second conductive thin films which extend in the first direction covers entire inner walls of the through holes of said second insulating plate, the through hole being located in a region on where said second conductive thin film is disposed.

* * * * *